United States Patent [19]

Guangorena

[11] 3,985,340

[45] *Oct. 12, 1976

[54] SELF TAILING WINCH

[75] Inventor: Jesus Guangorena, Atherton, Calif.

[73] Assignee: Barient Company, San Carlos, Calif.

[ * ] Notice: The portion of the term of this patent subsequent to July 13, 1993, has been disclaimed.

[22] Filed: Apr. 15, 1975

[21] Appl. No.: 568,304

[52] U.S. Cl. ..... 254/150 R; 254/138

[51] Int. Cl.[2] ..... B66D 1/30

[58] Field of Search ..... 254/150 R, 186 HC, 187 R, 254/138; 114/218; 74/812

[56] References Cited

UNITED STATES PATENTS

| | | | |
|---|---|---|---|
| 1,893,723 | 1/1933 | Wood | 254/150 R |
| 2,793,740 | 5/1957 | Daudt | 254/150 R |
| 3,034,767 | 5/1962 | Gordon | 254/138 |
| 3,120,043 | 2/1964 | Henley | 254/150 R |
| 3,712,155 | 1/1973 | Stommel et al. | 254/150 R |
| 3,809,368 | 5/1974 | Lawrence | 254/150 R |

*Primary Examiner*—Robert J. Spar
*Assistant Examiner*—Kenneth Noland
*Attorney, Agent, or Firm*—Owen, Wickersham & Erickson

[57] ABSTRACT

A self tailing winch with which a rope can be automatically pulled and paid out has a clamping ring attached to a rotary winch drum for rotation therewith. The ring has a central hub portion with a cylindrical surface that defines an annular groove with the end of the drum. The ring is yieldably urged against the end of the drum to clamp the rope. The rotary drum may be driven by a gear train from a rotated input shaft. A stationary annular plate fixed to a stationary frame is attached above the clamping ring and supports a downwardly and outwardly extending projection for deflecting the rope from the drum to the groove and also supports a device for paying out rope from the groove as the drum and ring are turned.

4 Claims, 7 Drawing Figures

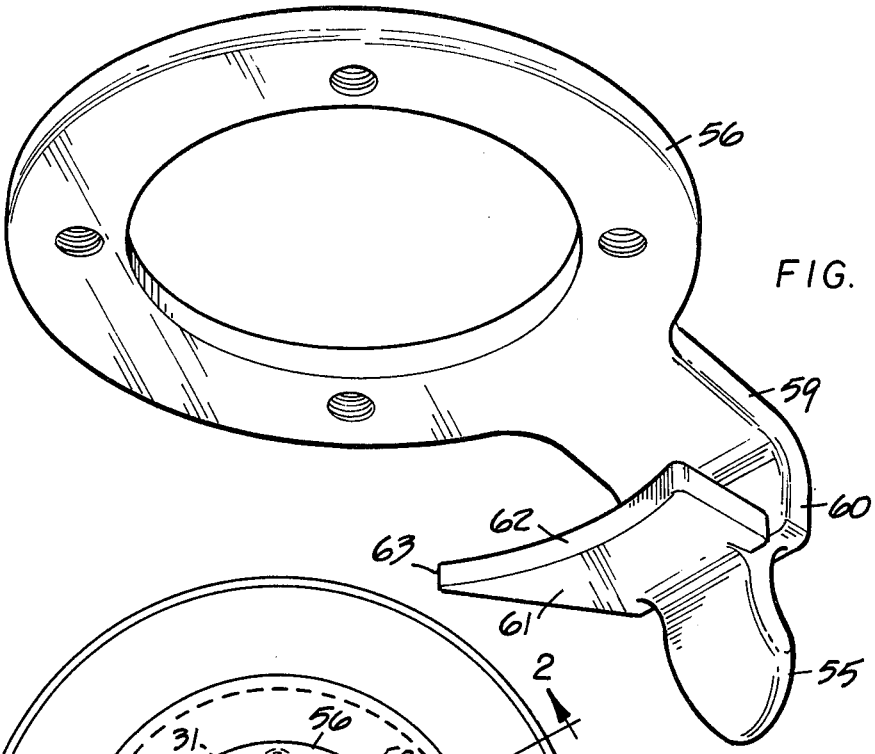
FIG. 4.
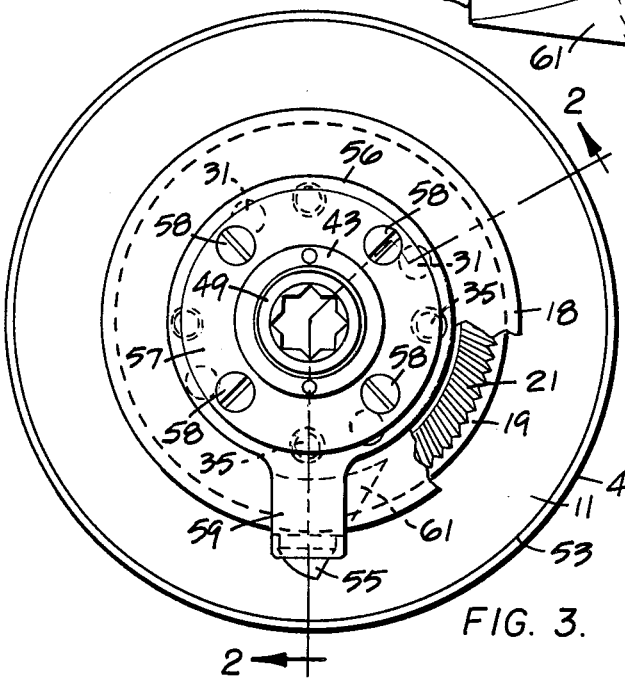
FIG. 3.
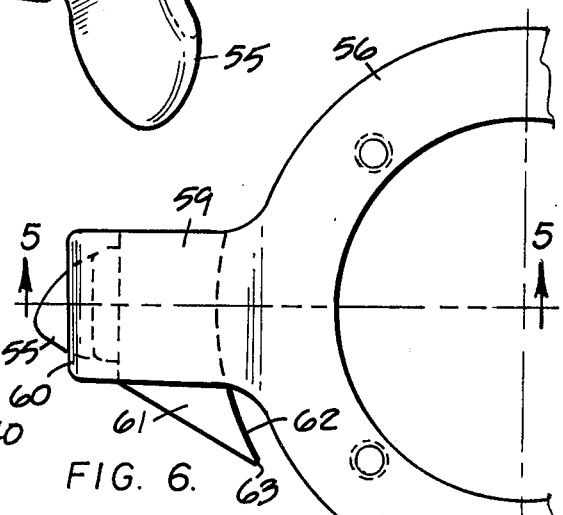
FIG. 6.
FIG. 7.
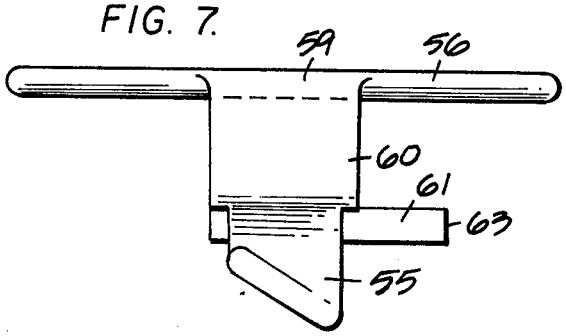
FIG. 5.
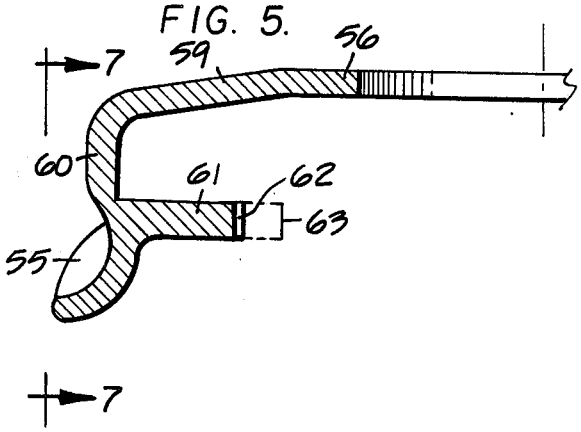

SELF TAILING WINCH

BACKGROUND OF THE INVENTION

This invention relates to an improved self-tailing winch for pulling a flexible line or rope and particularly adapted for use on sailing vessels.

For most winches heretofore used on boats, the rope or line to be pulled by the winch is wrapped around the winch drum and manually provided with tension as the winch is operated. On such winches it is necessary for the rope coming off of the drum to be paid out by hand or at least with hand assistance. To overcome these obvious disadvantages, attempts have been made to provide a so-called self tailing winch.

Self-tailing winches heretofore devised have utilized expensive V-groove pulley wheels fixed to a winch drum with the pulley wheel having transverse indentations corresponding to the shape of the rope in order to provide the necessary gripping power on the rope and prevent slippage. Such an arrangement is shown in U.S. Pat. No. 3,730,483. The present invention provides means for gripping the rope in a different manner and does not use a pulley or the specially shaped transverse indentations thereon, thereby eliminating unnecessary expense while providing increased effectiveness. The self-tailing winches with a pulley wheel heretofore in use also presented serious difficulties in operation due to the fact that different rope tensions and speeds occurred at the point where the rope was fed from the drum to the pulley wheel. This problem arose because for all but one particular diameter of rope, the rope in the pulley wheel could not get to the bottom of the V-groove and thus its loop diameter was greater than that on the winch drum. This created a differential speed between the rope on the pulley and the rope on the drum. Differential speeds between two such rope portions inevitably result in differential forces which cause trouble or made the winch difficult to operate. Often the tension created between the portion of rope on the pulley wheel and the portion on the drum was sufficient to break the rope. Thus, for a smooth operating self-tailing winch it is essential that the line speed of the rope unit entering the clamping means be identical to the line speed at which it leaves the winch drum so that no excessive tension forces exist. However, where a fixed pulley wheel is used, these speeds cannot be the same unless the diameter of the rope loop in the pulley groove is the same as the diameter of the rope loop on the drum from which it leaves.

Because of the aforesaid differential rope speed problem self-tailing winches having a pulley wheel with a fixed V-groove can be used with only one particular type of rope, or one diameter of rope in order to achieve the proper loop diameter, and this is a severe operating limitation. In the present invention it is possible to vary the rope diameter and the type of rope widely and still obtain satisfactory results, all without causing the differential speeds referred to above.

Therefore, among the objects of the invention are to provide a self-tailing winch which is both simpler in its general configuration and also more versatile in its operation.

Another object of the invention is to provide a self-tailing winch which will operate smoothly and efficiently with a wide variety of rope sizes and types, while still assuring proper pulling power and payout.

Another object of the invention is to provide a self-tailing winch with identical line speeds when entering the wheel and leaving the drum from which the rope is paid out, and to provide this even though the rope size may be varied.

Another more specific object of the invention is to provide a self-tailing winch which provides a winding drum with a line clamping and payout means on the drum and a line deflecting means mounted on top of the clamping means, all of which cooperate in an assembly comprised of a relatively small number of parts that are easy to assemble and maintain.

Still another object of the present invention is to provide an improved self-tailing winch that is particularly well adapted for ease and economy of manufacture.

SUMMARY OF THE INVENTION

The aforesaid and other objects are accomplished by a self-tailing winch in which a stationary frame supports a rotatable input shaft and a rotary drum, the drum being driven by the input shaft through a gear train. Attached to the upper end of the drum is a separate clamping ring which rotates with the drum and defines with its beveled upper end a generally annular groove. The inner face of the clamping ring is smooth and the drum end portion forming the groove with the ring is provided with serrations or some suitable roughened surface. The clamping ring is urged toward the drum end by spring means which are yieldable enough to enable various sizes of ropes to be accommodated. Thus, the clamp ring moves away from the drum end when larger rope sizes are used and toward it when smaller sizes are used. An annular plate which is anchored to the frame lies above the clamping ring and supports a downwardly extending line deflector which assists in feeding the rope from the drum to the groove. A portion extending from this deflector assists in paying out the rope from the groove as the drum is rotated.

With the aforesaid arrangement, the single clamp ring with its spring mounting achieves the object of providing that the line speed at which the rope enters the groove between the clamp ring is the same as the line speed at which it leaves the drum. The line is always urged to the bottom of this groove which is defined by an inner cylindrical portion of the ring. Adjustability in rope size is provided by the spring-mounted clamp ring, and adequate grip of the rope is provided by the combination of the serrations on the end of the drum and the smooth face of the clamp ring. Simplicity is achieved in the paying in and the paying out of the rope without having to provide an extra roller or a complicated gate means for that purpose, as has been the case in some of the previous self-tailing winches.

Other objects, advantages and features of the present invention will become apparent from the following detailed description of one embodiment thereof, presented in conjunction with the accompanying drawing.

BRIEF DESCRIPTION OF THE DRAWINGS:

FIG. 3 is a top view with portions broken away;

FIG. 4 is a view in perspective of the stationary annular member which provides guide means for feeding the rope into the groove between the clamp ring and drum and for paying out the rope from that groove;

FIG. 5 is a fragmentary view in elevation of the stationary annular member for the winch of FIG. 1, taken along line 5—5 of FIG. 6;

FIG. 6 is a fragmentary top view of the stationary annular member of FIG. 5; and FIG. 7 is a view in elevation of the stationary annular member taken along line 7—7 of FIG. 5.

DESCRIPTION OF A PREFERRED EMBODIMENT

Figure 1:
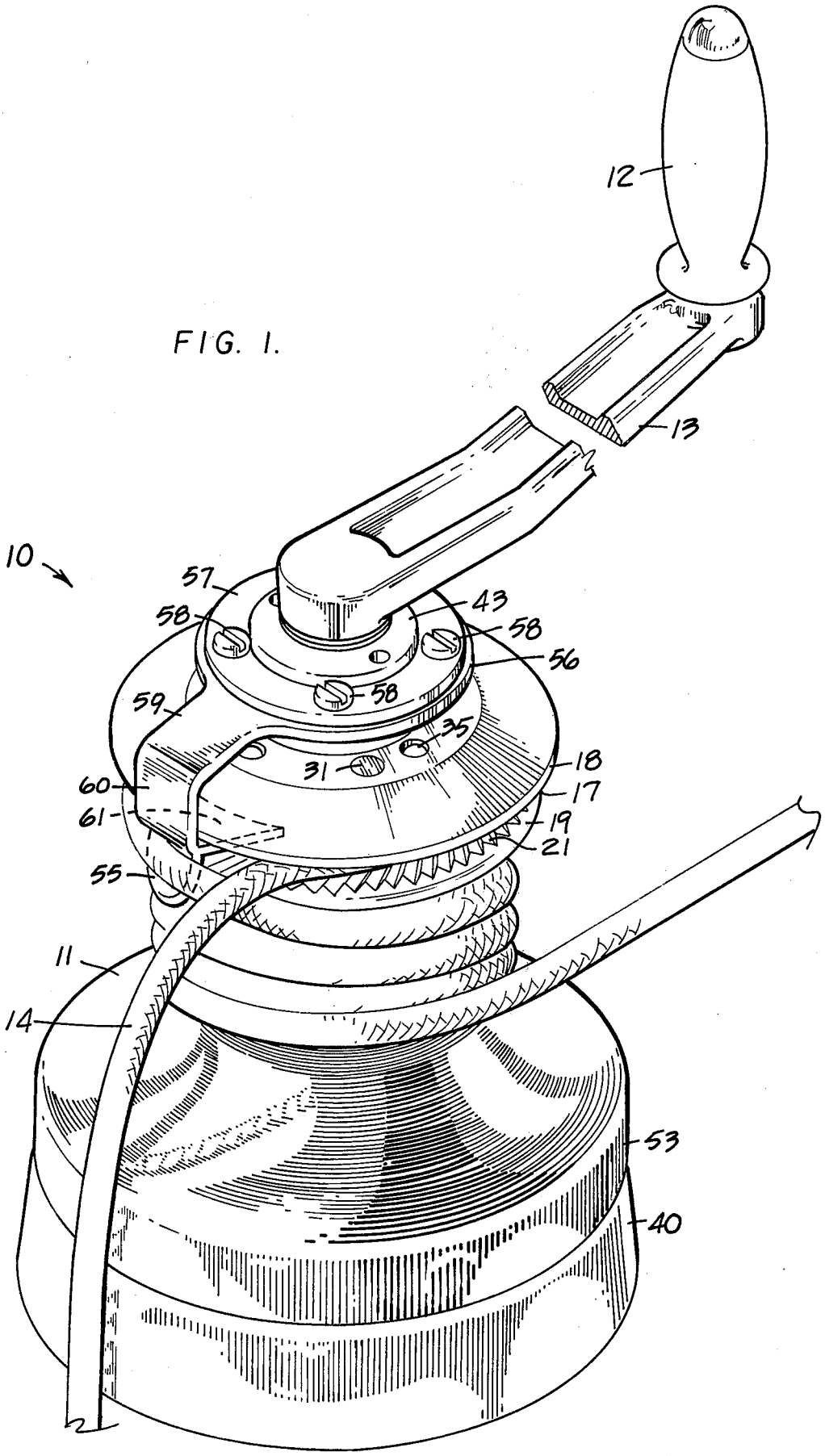
FIG. 1 is a view in perspective of a self-tailing winch embodying the principles of the invention.
Figure 2:
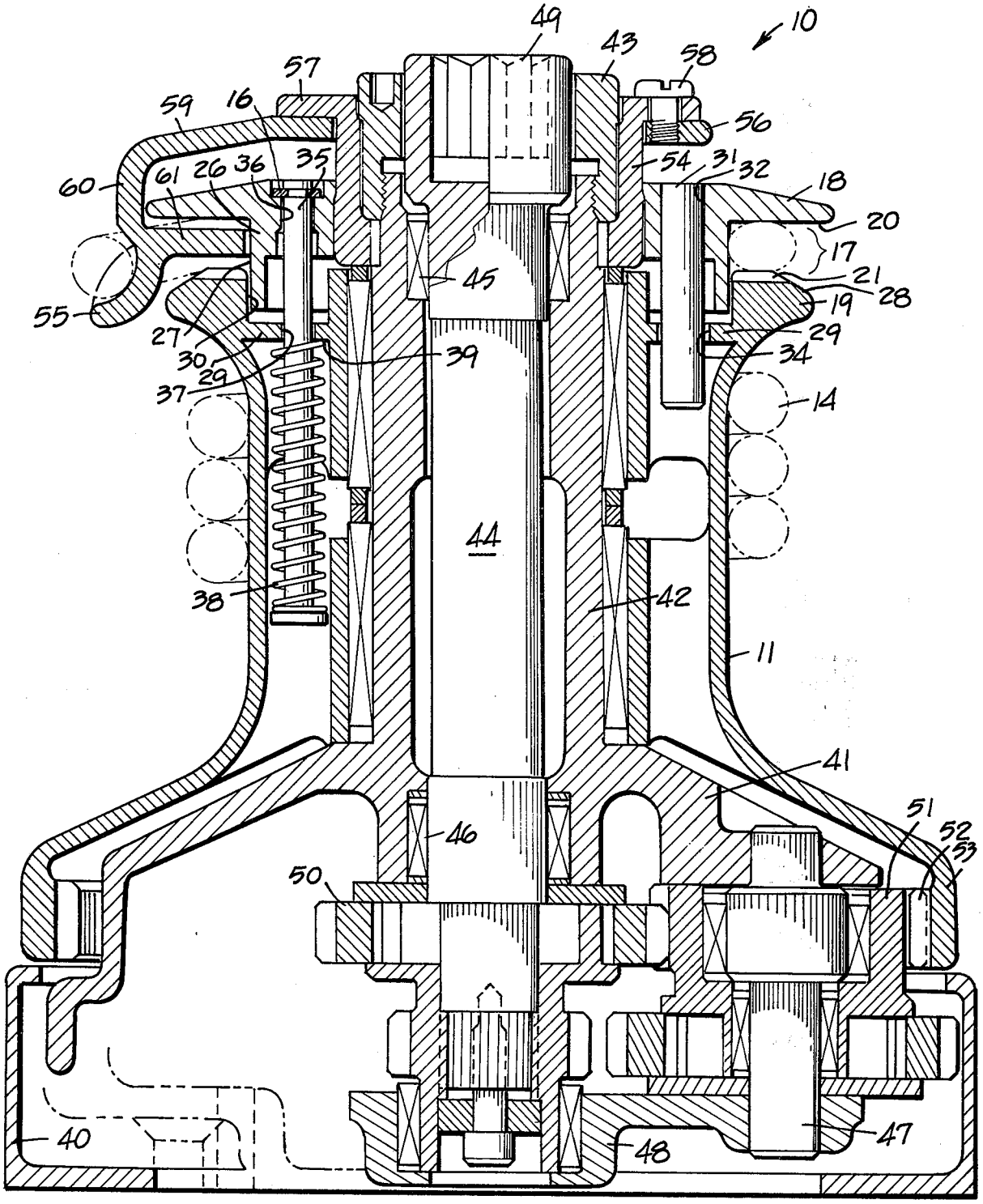
FIG. 2 is a view in elevation and in section of the winch of FIG. 1, taken along the line 2—2 in FIG. 3.

With reference to the drawing a self-tailing winch 10 embodying the principles of the invention is shown in perspective in FIG. 1 and in section in FIG. 2. As seen it generally comprises a drum 11 which is rotated when an operator moves a handle 12 to revolve a lever 13. This operation can wind up and pay out a rope 14, shown in FIG. 1 as having a portion going onto (or out from) the drum 11 and a portion coming out from (or going into) a generally annular groove 17 that is provided between a clamp ring 18 and an upper annular end portion 19 on the drum. As shown in FIGS. 2 and 1, the clamp ring 18 has a smooth inner face 20, forming the groove 17, while the annular drum face 19 has a serrated surface 21 also forming the groove 17. The surface 21 need not be serrated precisely as shown but may be grooved or roughened in some other suitable manner that will provide a non-slipping surface for the rope. If preferred, the roughened or grooved surface 21 could be on the clamp ring 18, and the operation is not affected by the interchange of surfaces 20 and 21.

Considering the specific example of FIGS. 1 – 7 in greater detail, it will be seen that the upper clamp ring 18 may have its smooth face 20 lie in a horizontal plane and lead into an annular cylindrical portion 26 having a cylindrical surface 27 marking the inner limit of the groove 17. The serrated face 21 of the drum end may also lie in a horizontal plane that extends radially inwardly from an angular edge surface 28 which helps to guide the rope between the surfaces 20 and 21. The end portion 19 of the drum that provides the face 21 may be formed as an annular flange-like member that is fixed to the main drum, as by welding or it may be formed integral therewith. Spaced inwardly from its outer edge 28 and surface 21 is an inset top portion 29 forming a cylindrical surface 30 that is adjacent to the cylindrical surface 27 of the clamp ring portion 26. The cylindrical surface 30 is slightly larger in diameter than the ring surface 27 and this allows the clamp ring 18 to move toward and away from the drum end portion 19.

In the example shown, the clamp ring 18 is shown splined by a series of studs 31 to the recessed top portion 29 of the drum 11 inwardly of the cylindrical surface 30. Each stud 31 is secured to the clamp ring by an interference fit within an opening 32 in the clamp ring. These studs extend downwardly through spaced apart openings 34 in the recessed top portion 29 of the drum (See FIG. 2). There is also a series of spring guide members 35 that extend through other openings 36 in the ring 18 and also through openings 37 in the drum top portion 29. Each guide member has a spring 38 secured to a head portion at its lower end and bearing against the drum top portion 29 at an under surface 39. Thus, the springs 38 are always exerting a force tending to pull the guide members downwardly axially and thereby cause the clamp ring 18 and its face 20 to move towards the drum end portion and its face 21. The upper end of each guide member is retained within an enlarged portion of an opening 36 by a transverse keeper or pin 16. As a rope 14 moves in between the two faces 20 and 21 it opposes the clamping force of the ring 18 and tends to force it away from the drum end against the spring force (See FIG. 2). Th springs 38 are made to provide the correct tension for accomplishing the desired clamping pressure on the rope. This can be readily determined and adjusted by one skilled in the art considering the size of the winch 10 and the general uses to which it is to be put.

The winch 10 may have a stationary base 40 constituting part of a stationary frame which also includes a gear housing 41 locked by one or more fingers to the base 40 and having a generally cylindrical shank 42 extending up to and threaded to a drum nut 43 near its upper end. The shank 42 surrounds a main rotary shaft 44 and provides antifriction bearings 45 and 46 for the shaft 44. One or more auxiliary shaft 47 is supported by the lower portion of the gear housing member 48.

A suitable driving connection for the main shaft 44 may be provided at its upper end by a broached key portion 49 for enabling a key end of the lever 13 to drive the shaft 44 and rotate it. The shaft 44 drives the drum 11 through a gear train at the lower end of the winch 10, most of which is shown in FIG. 2. The gear train may be of conventional design, having an upper gear 50 on the shaft 44 meshed with an upper gear 51 on the shaft 47, the gear 51 meshing with internal teeth 52 on an annular portion 53 of the drum 11.

Thus, when an operator rotates the handle 12, he revolves the lever arm 13, and this rotary action rotates both the drum 11 and the clamp ring 18 and provides a pulling force on the rope. Of course, other gear arrangements could be used for driving the drum, and a power drive may be used instead of a manual drive, when desired.

The stationary gear housing 41 and drum nut 43 act to hold in place an anchor sleeve 54, at the top of the winch, which fits around the drum nut 43 and in turn supports and retains a line deflector 55. As shown in FIGS. 4 – 6, the latter has an annular ring portion 56 that is secured to a flange 57 on the upper edge of the anchor sleeve 54, as by a series of spaced apart machine screws 58. Extending radially from the ring portion of the deflector 56 is an arm 59 having a downwardly projecting end portion 60 for supporting the line deflector 55. In the embodiment shown, the line deflector 55 is a tongue-like member on the arm end portion 60 that extends outwardly with a smooth curvature and is also sloped at an acute angle with respect to the central axis of the winch (See FIG. 7) so that it enables the rope 14 to pass up from the winch drum 11 into the groove 17. Projecting radially inwardly from the lower end of the arm end portion 59 of line deflector is a stripper member 61 that extends into the groove 17. It has a curved inner edge surface 62 that is spaced outwardly from the winding surface 27 by a sufficient distance so that for any size of rope with which the winch 10 is used a tapered end 63 of the stripper member will engage the rope and deflect it radially outwardly from the cylindrical ring surface 27. Thus, the stripper member is positioned so as to cause the rope portion 14 to pay out from the groove 17 during the payout operation, or to guide it back into the groove 17 during the reverse operation wherein the rope 14 is sent from the groove 17 back to the drum 11.

For normal operation of the winch 10, the operator holds the handle 12 and revolves the lever arm 13, which rotates the main shaft 44 and through the gear train 50, 51, 52 rotates the drum 11. A rope 14 which is given a few turns around the drum 11 can thereby be fed over the projecting deflector member 55 into the groove 17, where the rope 14 is engaged by the clamp ring 18 and pressed against the drum end surface 21. The rope is fed around the groove 17 and then paid out by the stripper member 61 which engages it near the ring cylindrical surface 27. Depending on the size of the rope 14, the springs 38 and the rope cooperate to seek the proper groove width at the bottom of the groove 17 against the surface 21. Since there are a plurality of springs 38 operating in equal ways and equally spaced apart, the pressure by the ring 18 on the rope is always kept uniform at all points and there is no slippage. Thus, the rope speeds throughout groove and coming out of the drum are always the same, thereby eliminating forces tending to break the rope. Similarly, the stripper member 61 operates to deflect or pay out the rope from the groove at the proper place and at the same speed at which it enters the groove 18 from the drum 11, via the deflector 55.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A self-tailing winch for a rope, including in combination:

a stationary frame, a rotary input shaft rotatably supported by said frame, a rotary drum rotatably supported by said frame, a gear train connecting said rotary input shaft to said rotary drum so that said drum is driven by said shaft, an axially movable clamp ring attached to and spaced from one end of said drum for rotation therewith, said ring and said drum end each having inner annular surfaces defining an annular groove between them, at least one of said annular surfaces having a serrated face for better gripping of a rope in the groove, spring means for urging said clamp ring toward said drum end yieldably, a generally cylindrical member mounted for rotation with said drum adjacent to and interior of said groove to define a constant winding diameter for a rope, said cylindrical member being of diameter substantially equal to the winding diameter of the drum, a stationary member anchored to said frame on top of said clamp ring, rope deflector means supported by said stationary member for assisting in feeding a rope from said drum to said groove, and rope stripping means supported by said plate for assisting in paying out the rope from said groove.

2. The self-tailing winch of claim 1 wherein said stationary member has a radially and downwardly extending arm, said rope deflector means projecting outwardly from said arm and also at an incline with respect to a plane perpendicular to the drum axis, whereby it deflects the rope from the drum into said groove.

3. The self-tailing winch of claim 2 wherein said rope stripping means supported by said stationary member is a stripper member secured to said arm that is generally parallel to said annular surfaces and extends inwardly into said groove for removing rope therefrom and deflecting it radially out of said groove as said drum is turned.

4. A self-tailing winch for a rope, including in combination:

a stationary frame;

a rotary input shaft rotatably supported by said frame;

a rotary drum rotatably supported by said frame;

means connecting said rotary input shaft to said rotary drum so that said drum is driven by saif shaft;

an axially movable clamp ring attached to and spaced from one end of said drum for rotation therewith, said ring and said drum end each having inner annular surfaces defining an annular groove between them for gripping a rope;

a cylindrical extension on said clamp ring together with said drum end forming an interior boundary of said groove, said extension being of substantially the same diameter as the winding diameter of the drum to define a constant winding diameter for a rope;

spring means for urging said clamp ring toward said drum end yieldably;

a stationary plate anchored to said frame on top of said clamp ring;

rope deflector means supported by said plate for assisting in feeding a rope from said drum to said groove, and rope stripping means supported by said plate for assisting in paying out said rope from said groove.

* * * * *

UNITED STATES PATENT OFFICE

CERTIFICATE OF CORRECTION

Patent No. 3,985,340 Dated October 12, 1976

Inventor(s) Jesus Guangorena

It is certified that error appears in the above-identified patent and that said Letters Patent are hereby corrected as shown below:

Column 6, line 8, "plate" should read -- stationary member --.

Signed and Sealed this

Tenth Day of May 1977

[SEAL]

*Attest:*

RUTH C. MASON
*Attesting Officer*

C. MARSHALL DANN
*Commissioner of Patents and Trademarks*